US005149238A

United States Patent [19]

McEldowney et al.

[11] Patent Number: 5,149,238

[45] Date of Patent: Sep. 22, 1992

[54] PRESSURE RESISTANT SHEET METAL END CLOSURE

[75] Inventors: Carl McEldowney, Russia; Philip Spangler, Sidney, both of Ohio

[73] Assignee: The Stolle Corporation, Sidney, Ohio

[21] Appl. No.: 648,045

[22] Filed: Jan. 30, 1991

[51] Int. Cl.[5] ..... B21D 22/30

[52] U.S. Cl. ..... 413/8; 72/348

[58] Field of Search ..... 413/8, 11, 62; 72/348, 72/349, 353.2

[56] References Cited

U.S. PATENT DOCUMENTS

| | | | |
|---|---|---|---|
| 3,326,405 | 6/1967 | Fraze | 220/54 |
| 3,417,898 | 12/1968 | Bozek et al. | 220/66 |
| 3,441,170 | 4/1969 | Khoury | 220/54 |
| 3,554,400 | 1/1971 | Bozek | 220/54 |
| 3,683,825 | 1/1972 | Franek et al. | 220/66 |
| 3,774,801 | 11/1973 | Gedde | 220/66 |
| 4,031,837 | 6/1977 | Jordan | 113/121 C |
| 4,093,102 | 6/1978 | Kraska | 220/67 |
| 4,434,641 | 3/1984 | Nguyen | 413/62 |
| 4,571,978 | 2/1986 | Taube | 413/62 |
| 4,577,774 | 3/1986 | Nguyen | 220/66 |
| 4,641,761 | 2/1987 | Smith et al. | 220/66 |
| 4,704,887 | 11/1987 | Bachmann | 413/56 |
| 4,832,223 | 5/1989 | Kalenak et al. | 220/66 |

FOREIGN PATENT DOCUMENTS 103074 3/1984 European Pat. Off. .

*Primary Examiner*—Bruce M. Kisliuk
*Assistant Examiner*—Jack W. Lavinder
*Attorney, Agent, or Firm*—David W. Brownlee

[57] ABSTRACT

A sheet metal end closure for a container of pressurized products, which closure includes a substantially planar central panel, a countersink around the central panel, a chuckwall around the countersink and a seaming flange around the chuckwall. It further includes an annular downwardly stepped portion between the central panel and the countersink and a coined zone in the panel radius which connects the stepped portion to the countersink. The invention includes a method and apparatus for forming such a sheet metal closure wherein the panel radius between the central panel and the countersink is coined around at least a portion of the circumference of the central panel before the periphery of the central panel is reformed. In accordance with this invention, a major portion of the central panel is moved away from the countersink by depressing the outer peripheral portion of the central panel along with the countersink and chuckwall. Depressing the peripheral portions of the end shell with respect to the central panel increases substantially the height of the central panel and uses the slack or loose metal created by the coining operation. This puts the metal in the end shell substantially into tension and helps reduce, or eliminates, central doming of the end shell due to internal pressure in a container on which the shell is seamed.

15 Claims, 2 Drawing Sheets

PRESSURE RESISTANT SHEET METAL END CLOSURE

BACKGROUND OF THE INVENTION

1. Field of the Invention

This invention relates to a sheet metal end closure for a can or other container. In particular, the present invention relates to a metal end closure having increased resistance to buckling due to internal pressures and to a method and apparatus for forming such an end closure.

2. Description of the Prior Art

The prior art teaches various method for increasing the pressure resistant capability of containers. Increasing the pressure resistance of containers is desirable for various reasons. First, containers having end shells of equivalent gauge can be made to withstand higher internal pressures. And, also, containers having end shells of thinner gauge can be made to withstand equivalent or higher pressures. Being able to reduce the gauge of the material used as end shells for containers, while maintaining adequate internal pressure resistance, has the significant advantage of material cost reduction.

Numerous United States and foreign patents have been issued which disclose various methods and apparatus for forming pressure resistant end shells. U.S. Pat. No. 4,031,837 teaches a method of reforming a conventional end shell by moving a drawing tool into a conventional annular groove while supporting the central wall of the end shell to draw the metal in the process of increasing the depth of the annular groove. U.S. Pat. No. 4,109,599 also teaches a method of forming a pressure resistant end shell for a container in which the reinforcing channel around the end shell is free formed without drawing of the metal. Thus, the thickness of the end shell is not reduced in a final forming operation.

It has been well known for many years to restrike or coin an annular zone or bead around a sheet metal end closure to improve its strength as is disclosed by U.S. Pat. No. 3,441,170. That patent discloses the utilization of loose metal in the end by mechanical doming of the end panel. Other patents that disclose coining of an annular zone or zones around the periphery of the central panel of an end shell to increase the pressure resistance include U.S. Pat. Nos. 4,577,774; 4,641,761; and 4,832,223, among others.

It is also known, as disclosed in published European Patent Application 0103074, to form a metal end shell of increased strength in which the countersink portion is connected to the central panel through at least three reversing curved portions. The published application discloses a coined horizontal portion between two of the reversing curved segments in the end shell. U.S. Pat. No. 3,774,801 discloses a reinforced metal can end having at least two peripheral, radially separated, concave areas of curvature which provide the end with increased resistance against pressure.

It is also known to provide a raised bead or beads in can ends to utilize excess metal that may result from scoring or coining portions of the can ends as disclosed by U.S. Pat. No. 3,554,400. Other disclosures of raised beads include U.S. Pat. Nos. 3,417,898; 4,093,102; 3,326,405; and 3,638,825.

Despite significant progress in the area of increasing the pressure resistant capabilities of end shells for containers, there is still a need for further improvement.

Accordingly, a new and improved pressure resistant end shell and a method and apparatus for forming the same are desired to increase the pressure hold capabilities.

SUMMARY OF THE INVENTION

The sheet metal end closure of this invention is for a container of pressurized products and includes a substantially planar central panel, a countersink around the central panel, a chuckwall around the countersink and a seaming flange around the chuckwall. It further includes an annular downwardly stepped portion between the central panel and the countersink and a coined zone in the panel radius which connects the stepped portion to the countersink. The invention includes a method and apparatus for forming such a sheet metal closure wherein the panel radius between the central panel and the countersink is coined around at least a portion of the circumference of the central panel before the periphery of the central panel is reformed. In accordance with this invention, a major portion of the central panel is moved away from the countersink by depressing the outer peripheral portion of the central panel along with the countersink and chuckwall. Depressing the peripheral portions of the end shell with respect to the central panel increases substantially the height of the central panel and uses the slack or loose metal created by the coining operation. This puts the metal in the end shell substantially into tension and helps reduce, or eliminates, central doming of the end shell due to internal pressure in a container on which the shell is seamed.

DESCRIPTION OF PREFERRED EMBODIMENT

Figure 1:
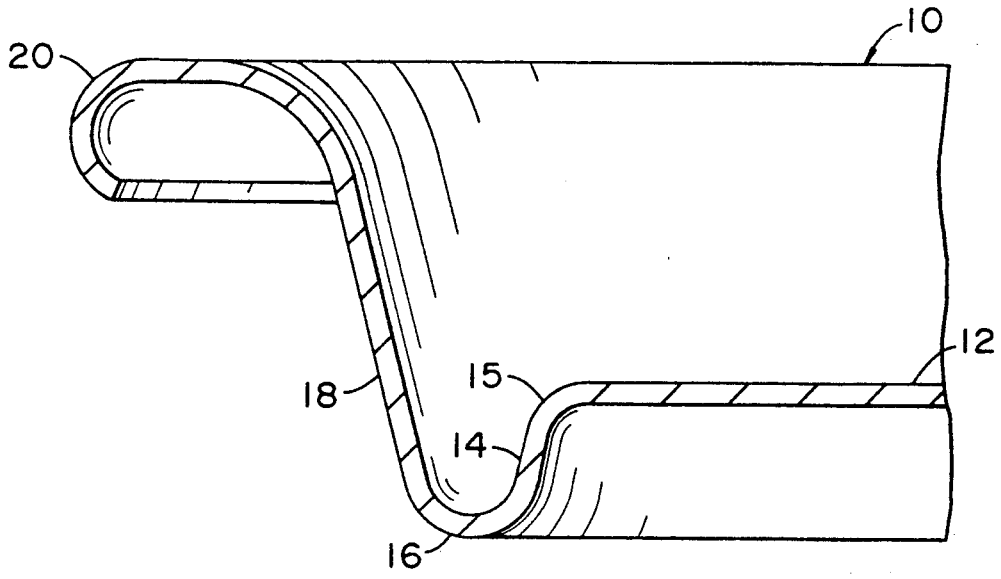
FIG. 1 is a fragmentary cross-sectional view of a conventional end shell prior to being reformed in accordance with this invention.

FIG. 1 shows a conventional end shell 10 prior to being reformed in accordance with this invention. The end shell 10 has a substantially planar central panel portion 12, a panel radius 15 around the central panel portion, a panel wall 14 extending downwardly from the panel radius, a countersink or countersink radius 16 outwardly of the panel wall 14, and upwardly extending substantially frustoconical chuckwall 18 extending from the countersink to a curved flange 20 around the chuckwall for double seaming or otherwise attaching the sheet metal end closure to a can or other container, not shown.

The end shell 10 has an interior surface adapted for exposure to the contents of the container and an exterior surface for exposure to the environment. The end shell is typically formed of sheet metal, such as an aluminum alloy 5182 in coated extra hard H-19 temper. The aluminum end shell typically has a gauge within a range of from 0.0085 to 0.012 inch. In the embodiment selected for illustration the metal thickness is 0.0113 inch. Materials other than aluminum sheet metal, including steel, tinplate, polymer-aluminum laminates, and composite materials, are comprehended by the present invention.

Figure 3:
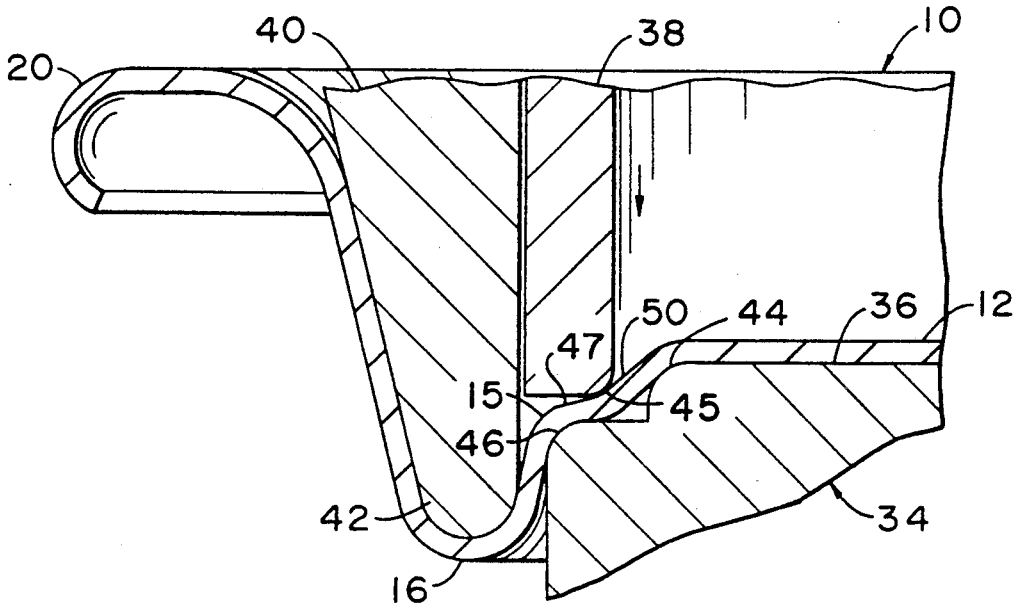
FIG. 3 is a fragmentary cross-sectional view of the end shell of FIG. 2 after it has been coined and showing preferred tools for reforming of the central panel portion of the end shell to produce a downwardly stepped portion between the central panel and the countersink in the end.

The end shell 10 may be of conventional configuration as shown in FIG. 3 of U.S. Pat. No. 4,031,837 or may have been reformed as disclosed in U.S. Pat. No. 4,031,837 or formed in accordance with U.S. Pat. No. 4,109,599. Reforming or forming of the end shell in accordance with those patents will increase the pressure resistance of the shell and strengthen the central panel against central doming.

Figure 2:
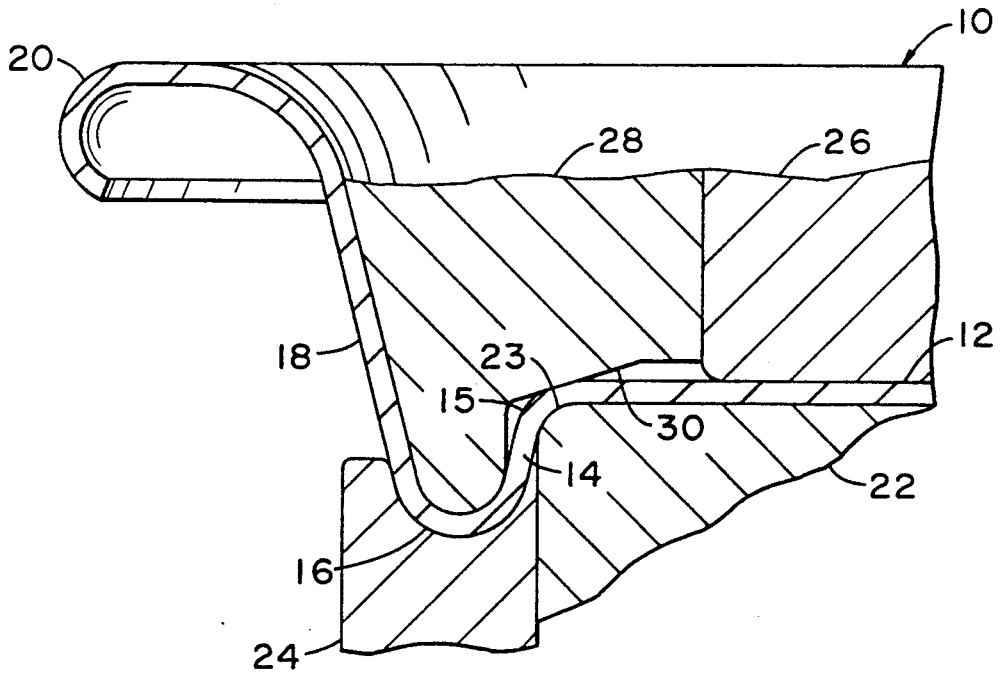
FIG. 2 is a fragmentary cross-sectional view of the end shell of FIG. 1 as it is being coined in accordance with this invention with a preferred tool set.

In accordance with this invention, an end shell of FIG. 1 is first coined as is illustrated in FIG. 2. The tools for coining the end shell include a lower form cap 22, a centering ring 24, a pressure pad 26, and a coining tool 28. The coining tool 28 includes an angled or frustoconical coining surface 30 for coining a relatively narrow zone of metal in the panel radius 15 as supported by the radius 23 on the lower form cap tool 22. Depending on the selection of the particular metal end closure 10, the tools of FIG. 2 may also be employed to reform the end shell to increase the diameter of the central panel and reform the panel wall 14 so that it is substantially vertical as is disclosed by U.S. Pat. No. 4,031,837. Alternatively, an end shell 10 may be selected that has been formed in accordance with U.S. Pat. No. 4,109,599 to have a substantially vertical panel wall which therefore does not require reforming in the tools of FIG. 2. For end shells which have been formed in accordance with U.S. Pat. No. 4,109,599, the tools of FIG. 2 will coin the end shell at the panel radius 15 and need not reform the panel wall 14.

In the operation of the tools of FIG. 2, the closure 10 may be carried from station to station by a non-stretchable belt (metal or non-metal) in a manner well known in the art. The belt, not shown, carries the end shell between the upper and lower tools when they are open. Closing of the tools by the press operation accurately seats the closure in the tools and coins the panel radius. The closure may also be reformed by the tools as discussed above.

In a preferred method of practicing this invention, the panel radius 15 is coined around the entire circumference of the central panel of the end closure. The width of the coined area as measured on the exterior surface of the can end may be approximately 0.020–0.040 inch, and the metal is coined to leave a residual metal thickness of approximately 0.009 inch within the coined area. Coining the panel radius works the metal in the coined area and thereby strengthens the radius and makes the end closure more resistant to buckling from internal pressure in a container on which the end shell is attached. Coining the panel radius in the end shell also produces increased surface area of metal in the end shell and produces loose or slack metal which is undesirable in that it may result in doming of the central panel under internal pressure. One reason that central doming of the panel of the can end is undesirable is that it could result in a premature lifting of an opening tab on the central panel, called "tab rise".

In accordance with this invention, the coined end shell from the operation illustrated in FIG. 2 is preferably transferred by a belt, not shown, to another set of tools as illustrated in FIG. 3 to reform the end shell. These tools include a reform cap tool 34 having a cap 36 thereon, a forming ring 38 and centering ring 40 having a nose 42. The cap 36 on the reform cap tool 34 has an annular radius 44 around its periphery which has a radius of curvature of approximately 0.022 inch in the preferred tools. The reform cap tool 34 also has a radius 46 around its periphery having a radius of curvature of 0.018 inch in the preferred embodiment. This radius 46 is preferably approximately the same as the radius 23 on the lower form cap tool 22 illustrated in FIG. 2. Thus, the panel radius 15 is preferably not reformed by the tools illustrated in FIG. 3.

In the operation of the tools of FIG. 3, the end shell 10, as preferably carried from station to station in a moving belt, is moved downwardly by the forming ring 38 and pressed against the reform cap tool 34 to form an annular stepped portion 50 around the periphery of the central panel of the end shell. The forming ring 38 has a radius 45 of approximately 0.015 inch on its bottom inner corner which presses against the upper surface of the central panel portion 12 to depress the periphery of such central panel portion into the annular step between the radii 44 and 46 on the reform cap tool.

The action of the forming ring 38 pressing downwardly against the end shell 10 as supported by the reform cap tool 34 reforms the outer periphery of the central panel to form the downwardly stepped portion 50 in such central panel and draws a major portion of the central panel upwardly with respect to the countersink 16. This reforming of the central panel utilizes essentially all of the excess or loose metal in the end closure which may have been produced by the coining operation of FIG. 2 and places the metal in the raised central panel portion substantially in tension. This is an important aspect of the present invention in that utilizing all of the loose metal and placing the panel in tension substantially reduces buckling tendencies of the end shell and also substantially eliminates the tendency of the central panel to bulge or dome upwardly under internal pressure in a container on which the end shell is sealed. It is desirable to reduce such upward doming because such doming can cause elevation or lifting of the tab on an easy opening end formed on the end shell and tab lifting can result in undesirable consequences of accidental opening or stacking difficulty. Thus, the sequence of forming the step after coining is an important feature of this invention.

Reforming of an end shell in accordance with this invention effects a substantial increase in the height of the central panel portion with respect to the bottom of the countersink. In a preferred embodiment of this invention, the height of the central panel portion is increased from an original height of approximately 0.078 inch to a final height of approximately 0.110 inch.

Figure 4:
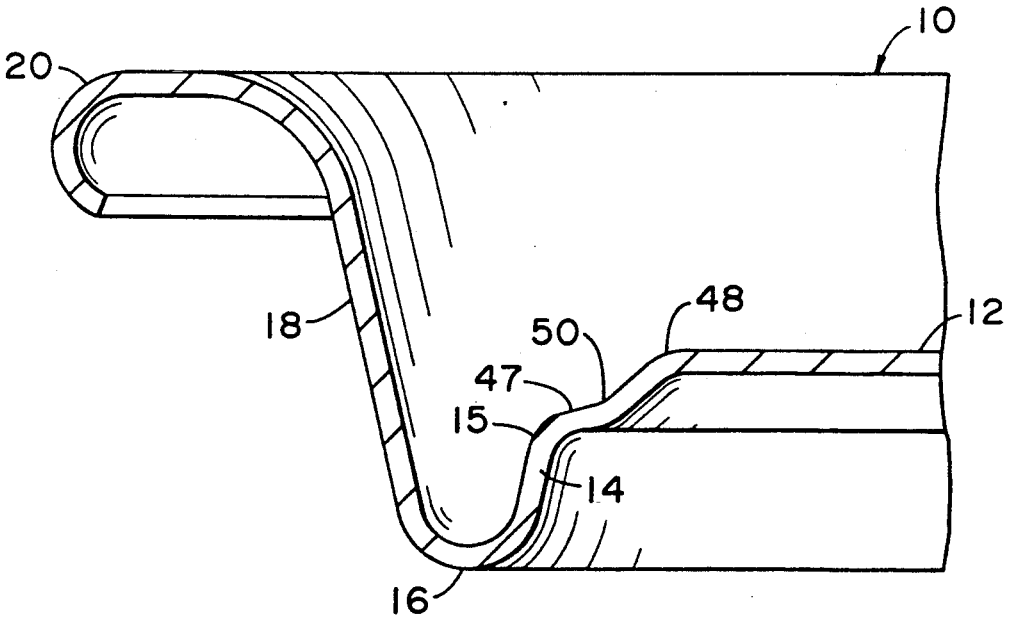
FIG. 4 is a fragmentary cross-sectional view of a reformed sheet metal end closure of this invention after it has been reformed in accordance with the method of this invention.

FIG. 4 illustrates an end shell of this invention after it has been coined and reformed as shown in FIGS. 2 and 3. As coined and reformed, the end shell 10 includes a substantially planar central panel 12, an annular stepped portion 50 around the central panel portion, a first panel radius 15 outwardly of the stepped portion 50, a second panel radius 48 between the stepped portion and the central panel portion, and a coined zone 47 in the panel radius 15 adjacent to the stepped portion 50. The end closure further includes a panel wall 14, a countersink 16, a chuckwall 18 and a curved flange 20 for attachment of the end closure to a container. The panel wall 14 of an end shell of this invention is preferably substantially vertical but may be inclined slightly inwardly or outwardly from top to bottom. In a preferred embodiment the panel wall 14 may be inclined to a negative angle or slightly inwardly from top to bottom to provide enhanced pressure resistance capability. The embodiment selected for purposes of illustration has a central panel portion which is raised approximately 0.030 inch above the upper surface of the panel radius 15 and a countersink which is approximately 0.077 inch below the upper surface of the panel radius. The first panel radius 15 has a radius of curvature on its inside surface of approximately 0.018 inch, and the second panel radius 48 has a radius of curvature on its inside surface of approximately 0.022 inch. The coined zone 47 is approximately 0.30 inch wide and has a metal residual thickness of approximately 0.009 inch. The stepped portion 50 of the end closure has a width of approximately 0.055 inch and extends around the entire periphery of the central panel portion 12.

While it is believed that the best mode of practicing the invention has been described above, it will be appreciated by those skilled in the art that numerous variations may be made in the illustrated and described detail without departing from the scope of the invention or the claims appended hereto.

For example, the two sets of tools illustrated in FIGS. 2 and 3 could be combined into a single, double acting set or be split into three stations. The upper forming ring 38 and coining tool 28 can also be separated into inner and outer portions to provide a separate countersink ring tool for seating in the countersink of an end shell. The stepped portion 50 of the end shell could also comprise two or more smaller steps rather than the one step as illustrated. The coined zone in the end may also be formed in two or more segments around the end with uncoined metal between the ends of the segments. Other variations will be obvious to those skilled in the art.

What is claimed is:

1. A method of forming a sheet metal closure to provide increased buckle resistance comprising in sequence the steps of providing a sheet metal closure having a central panel, a panel radius around the central panel having an outer peripheral portion, a countersink around the panel radius, a chuckwall around the countersink, and a curved flange around the chuckwall, said countersink having a bottom and said central panel disposed above said bottom, coining said panel radius around at least a portion of the circumference of said central panel, and reforming said central panel by supporting a major portion of the undersurface thereof and reforming the outer peripheral portion of said central panel into a stepped portion while moving said countersink radius, chuckwall and curved flange downward with respect to the major portion of the central panel to increase substantially the height of said central panel above the bottom of said countersink.

2. A method as set forth in claim 1 in which said central panel has a diameter and said metal closure is reformed to increase said diameter during the step of coining said panel radius.

3. A method as set forth in claim 1 in which reforming of the outer peripheral portion of said central panel increases the height of said central panel by at least approximately 20%.

4. A method as set forth in claim 1 in which reforming of the outer peripheral portion of said central panel increases the height of said central panel measured from the bottom of the countersink by approximately one-third.

5. A method as set forth in claim 1 in which said central panel has a circumference and said panel radius is coined around the entire circumference of the central panel.

6. A method of forming a pressure resistant sheet metal closure comprising in sequence the steps of forming a sheet metal closure having a central panel having a predetermined circumference and a center portion, a downwardly projecting countersink around the central panel and having a junction therewith, a generally frustoconical chuckwall around the countersink and a curved attachment flange around the chuckwall, said closure having surface area and said central panel disposed above said countersink, coining the metal in the closure near the junction of said central panel and said countersink around a major portion of the circumference of the central panel and thereby increasing the surface area of metal in the closure, and reforming said central panel by substantially increasing the height of said center portion thereof spaced inwardly of said countersink to utilize the increased surface area of metal produced by said coining and place the metal in the closure in tension.

7. A method as set forth in claim 6 in which increasing the height of a major portion of said central panel creates a downwardly stepped portion around the periphery of said central panel.

8. A method as set forth in claim 7 in which said stepped portion has a narrow width in a range of approximately 0.040 to 0.070 inch.

9. A method as set forth in claim 6 in which the height of said central panel measured from the bottom of the annular groove is increased by at least 20%.

10. A method as set forth in claim 6 in which said countersink has an inner wall and an outer wall and in which the diameter of said central panel is increased and a portion of the inner wall of said countersink is oriented to be substantially vertical.

11. A method as set forth in claim 10 in which the diameter of the central panel is increased and the inner wall of said countersink is oriented substantially simultaneously with said coining of the metal in the closure.

12. Apparatus for forming a sheet metal closure having a central panel which includes a center portion, an undersurface, and an upper surface, a panel radius around the central panel, a countersink around and below the panel radius, a chuckwall around the countersink, and a curved flange around the chuckwall comprising means for coining the panel radius in said closure around at least a portion of the circumference of the central panel, and means for reforming the central panel subsequent to said coining by substantially increasing the height of said center portion thereof spaced inwardly of the countersink and forming a downwardly stepped portion between the central panel and the panel radius.

13. Apparatus as set forth in claim 12 in which said means for reforming the central panel of the closure includes a reform cap tool having a central cap thereon for supporting a major portion of said undersurface of the central panel of the closure, a countersink ring for seating in the countersink, and a forming ring for reforming the periphery of the central panel and forming a downwardly stepped portion therearound.

14. Apparatus as set forth in claim 13 in which the central cap on said reform cap tool has a height in a range of approximately 0.020 to 0.040 inch over an annular surface around the reform cap tool.

15. Apparatus as set forth in claim 14 in which said annular surface has a radial width in a range of approximately 0.040 to 0.070 inch.

* * * * *